US008840351B2

(12) United States Patent
Adler et al.

(10) Patent No.: US 8,840,351 B2
(45) Date of Patent: Sep. 23, 2014

(54) BOOK BINDING MACHINE AND METHOD FOR OPERATING A BOOK BINDING MACHINE

(75) Inventors: Michael Adler, Holzweissig (DE); Frank Sommerer, Leipzig (DE); Andreas Steinert, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 358 days.

(21) Appl. No.: 12/728,355

(22) Filed: Mar. 22, 2010

(65) Prior Publication Data

US 2010/0239392 A1 Sep. 23, 2010

(30) Foreign Application Priority Data

Mar. 20, 2009 (DE) ..... 10 2009 014 182

(51) Int. Cl.

| | |
|---|---|
| ***B42C 13/00*** | (2006.01) |
| ***B42C 9/00*** | (2006.01) |
| ***B42C 11/00*** | (2006.01) |
| ***B42C 11/02*** | (2006.01) |
| ***B42B 5/00*** | (2006.01) |
| ***B42C 19/08*** | (2006.01) |
| *B42C 1/12* | (2006.01) |

(52) U.S. Cl.

CPC . *B42C 19/08* (2013.01); *B42C 1/12* (2013.01); *B42C 9/0037* (2013.01); *Y10S 412/901* (2013.01); *Y10S 412/902* (2013.01)

USPC ..... 412/11; 412/1; 412/4; 412/6; 412/8; 412/9; 412/12; 412/14; 412/19; 412/33; 412/37; 412/901; 412/902

(58) Field of Classification Search

USPC ..... 412/1, 4, 6, 8, 9, 11, 14, 19, 33, 37, 412/901, 902, 12, 38; 99/1, 4, 6, 8, 9, 11, 99/14, 19, 33, 37, 901, 902

See application file for complete search history.

(56) References Cited

U.S. PATENT DOCUMENTS

| | | | |
|---|---|---|---|
| 5,613,669 | A | 3/1997 | Grueninger |
| 7,210,887 | B2 | 5/2007 | Engert et al. |
| 7,918,635 | B2 | 4/2011 | Richter |
| 7,976,002 | B2 | 7/2011 | Hoffmann et al. |

(Continued)

FOREIGN PATENT DOCUMENTS

| | | | |
|---|---|---|---|
| DE | 1216837 | B | 5/1966 |
| DE | 10221542 | A1 | 11/2003 |

(Continued)

*Primary Examiner* — Shelley Self
*Assistant Examiner* — Justin V Lewis
(74) *Attorney, Agent, or Firm* — Laurence A. Greenberg; Werner H. Stemer; Ralph E. Locher

(57) ABSTRACT

A book binding machine includes a collating machine, a perfect binder and a transfer device disposed between the collating machine and the perfect binder. The collating machine and the perfect binder are actuated by a common control device. In each case, one transport segment is assigned to a respective book block clamp by the control device. The control device also has a program which, if a defective or missing book block clamp is detected, actuates the collating machine in such a way that no book block is collated for that book block clamp. A method for operating a book binding machine is also provided.

13 Claims, 1 Drawing Sheet

(56) References Cited

U.S. PATENT DOCUMENTS

| | | | | |
|---|---|---|---|---|
| 7,988,138 | B2 | 8/2011 | Brünner et al. | |
| 2003/0215309 | A1* | 11/2003 | Engert et al. | 412/33 |
| 2007/0272361 | A1* | 11/2007 | Cracknell et al. | 412/33 |
| 2008/0012195 | A1 | 1/2008 | Abegglen | |
| 2008/0260497 | A1* | 10/2008 | Abegglen et al. | 412/8 |
| 2009/0148215 | A1* | 6/2009 | Takahashi et al. | 412/19 |
| 2010/0134253 | A1 | 6/2010 | Mäder | |

FOREIGN PATENT DOCUMENTS

| | | | |
|---|---|---|---|
| DE | 202005007012 | U1 | 8/2005 |
| EP | 1873103 | A1 | 1/2008 |
| EP | 1918232 | A1 | 5/2008 |
| EP | 2080634 | A1 | 7/2009 |
| WO | 2008012075 | A2 | 1/2008 |
| WO | 20080144945 | A2 | 12/2008 |

* cited by examiner

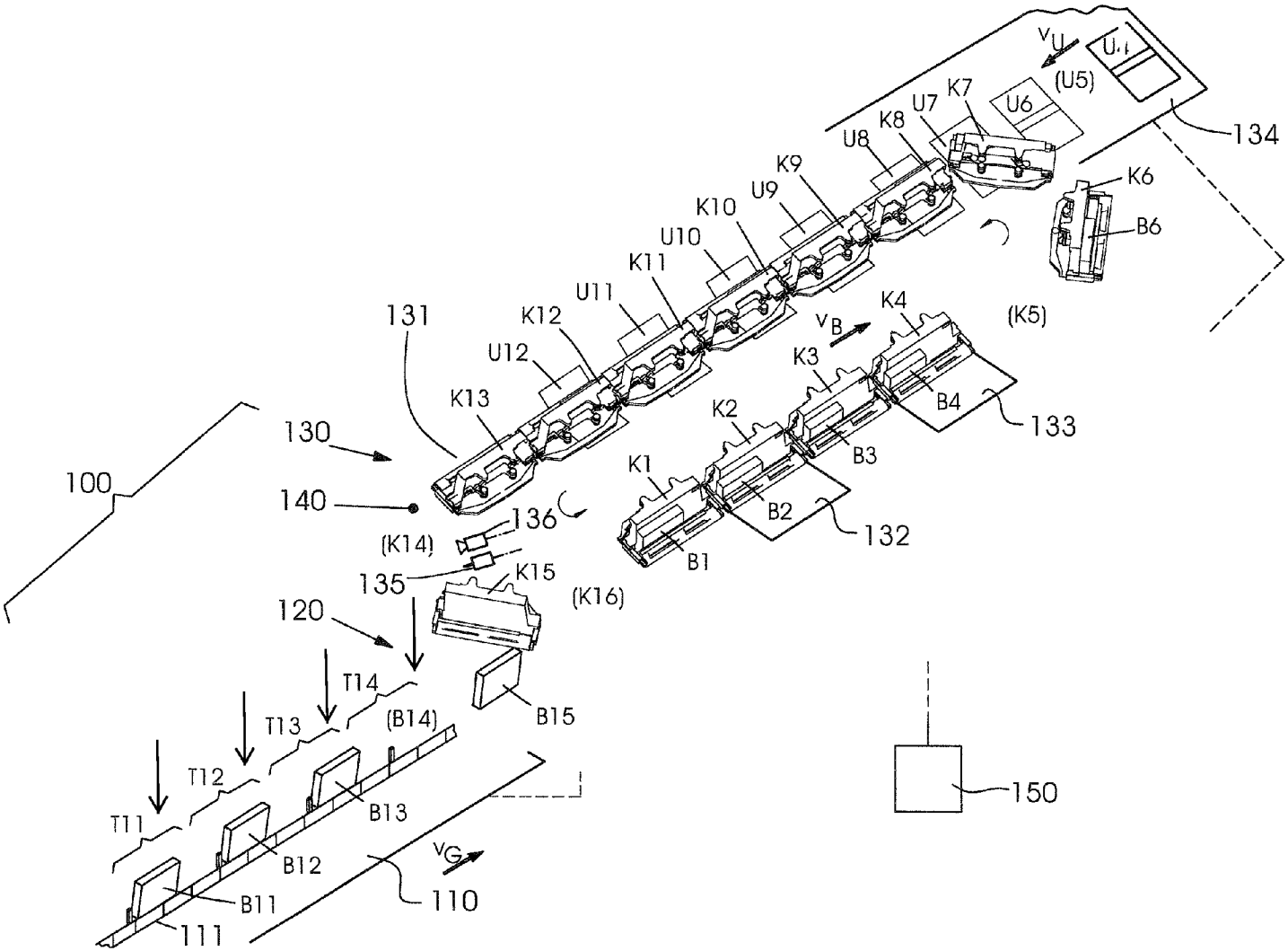
134
U1
(U5)
$v_U$
U6
K6
B6
K7
U7
K8
U8
K9
U9
K10
U10
K11
U11
K12
U12
K13
131
130
140
(K5)
133
K4
B4
$v_B$
K3
B3
132
K2
B2
K1
B1
136
(K14)
K15
(K16)
B15
135
120
T14
(B14)
B13
T13
B12
T12
B11
T11
111
$v_G$
110
100
150

BOOK BINDING MACHINE AND METHOD FOR OPERATING A BOOK BINDING MACHINE

CROSS-REFERENCE TO RELATED APPLICATION

This application claims the priority, under 35 U.S.C. §119, of German Patent Application 10 2009 014 182.0, filed Mar. 20, 2009; the prior application is herewith incorporated by reference in its entirety.

BACKGROUND OF THE INVENTION

Field of the Invention

The invention relates to a book binding machine, including a collating machine for collating book blocks with a gathering device which has a plurality of transport segments, a perfect binder for processing the book blocks for producing perfect bound brochures or books with a book block transport system which has a plurality of book block clamps for transporting the book blocks through processing stations such as a spine processing station, an adhesive application station and a cover feeding station, and a transfer device which is disposed between the collating machine and the perfect binder for transferring the collated book blocks from the gathering device to the book block transport system. The collating machine and the perfect binder are actuated by a common control device. The invention also relates to a method for operating a book binding machine.

According to the prior art, books are produced in book binding machines. Such a machine includes a plurality of machines which are disposed behind one another and are linked to one another through a book conveying device: machines for collating book blocks, for book binding, machines for drying and/or cooling, for side trimming and for stacking the finished books.

Collating machines serve to collate book blocks from a multiplicity of folded sheets and include two important elements: a device for transporting the gathered sheets, a so-called block gatherer, and a plurality of feeders. The block gatherer can have, for example, a gathering channel with drivers which push the gathered sheets. As an alternative, the block gatherer can have transport compartments which circulate on a conveying device. The feeders can be configured as feeders with gripper tongs or feeders with a gripper drum.

German Published, Prosecuted Patent Application DE 1 216 837 discloses a collating machine of that type with feeders having gripper tongs disposed in a row next to one another and with an endless conveying device which is provided with drivers. The collating machine has both a book block delivery device and a transfer device for transferring the book blocks to a following machine for further processing, such as a perfect or adhesive binder.

Another collating machine is disclosed in European Patent Application EP 1 873 103 A1, corresponding to U.S. Patent Application Publication No. US 2008/0012195 A1. It has a conveying apparatus with a circulating drawing device having a plurality of receiving points. Feeders which deposit signatures into the receiving points are disposed along the conveying apparatus. A sensor which is present checks whether the receiving points are defective or functional. In the case of a defect, the feeders are actuated by a machine controller in such a way that no signatures are deposited into the defective receiving point.

Perfect or adhesive binders serve to produce perfect bound brochures or book blocks for hardcovers, with the individual sheets and/or folded sheets which are collated to form a book block being connected by application of an adhesive or glue to the previously processed block spine. In the following text, the expressions glue and adhesive are used as synonyms. The possible binding processes and the product variants are dependent on the machine equipment. The latter includes substantially the functional units book block transport system, book block insertion system, spine processing device, spine gluing device, intermediate drying device, side gluing device, spine reinforcing device, cover feeding and pressing device, cover pressing and drying device.

German Utility Model DE 20 2005 007 012 U1 discloses a perfect binder of that type. It has a book block transport system including a conveying device which runs around deflection wheels and a multiplicity of clamps which are fastened at an identical spacing from one another on the conveying device for clamping sheet stacks. The clamps transport the sheet stacks and glued book blocks through the different processing stations.

It is a disadvantage of book binding machines according to the prior art that, in the case of a defective book block clamp of the perfect binder, the book binding machine has to be stopped, in order to exchange the defective clamp if there is a replacement clamp present, or otherwise in order to repair the clamp. During that time, the book binding machine cannot be operated, which considerably reduces its productivity which is particularly problematic in the case of time-critical production jobs. The provision of replacement clamps also represents an unpopular tying up of capital. Furthermore, in the case of a necessary clamp exchange, a sufficiently qualified expert person has to be present.

A further problem is that the quality of book blocks which are already situated in the perfect binder is reduced considerably by shutting down the book binding machine, that is to say the interrupted processing operation. That is because the adhesive can harden partially during the shutdown time so that a subsequently attached cover no longer adheres correctly. Furthermore, the book blocks may even have to be rejected as being broken.

SUMMARY OF THE INVENTION

It is accordingly an object of the invention to provide a book binding machine and a method for operating a book binding machine, which overcome the hereinafore-mentioned disadvantages of the heretofore-known machines and methods of this general type and which, in particular, can nevertheless be operated in the case of a defect of a book block clamp.

With the foregoing and other objects in view there is provided, in accordance with the invention, a book binding machine, comprising a collating machine for collating book blocks, the collating machine having a gathering device with a plurality of transport segments. Furthermore, the book binding machine includes a perfect or adhesive binder for processing the book blocks, for producing perfect bound brochures or books, the perfect binder having a book block transport system with a plurality of book block clamps for transporting the book blocks through processing stations of the perfect binder. The processing stations can be a spine processing station, an adhesive application station, a slip fold station and a cover feeding station. A further element of the book binding machine is a transfer device which is disposed between the collating machine and the perfect binder for transferring the collated book blocks from the gathering device of the collating machine to the book block transport system of the perfect binder. In this case, according to the invention, the collating machine and the perfect binder are actuated by a common control device. In an advantageous way, in each case one transport segment of the gathering device of the collating machine is assigned to the respective book block clamp of the perfect binder by this control device. As a result of this assignment of a transport segment to a book block clamp, the collation of book blocks can already be advantageously adapted in the collating machine in the case of a missing or defective book block clamp, without it being necessary for the book binding machine to be stopped in the process.

In accordance with another feature of the book binding machine of the invention, the control device has a machine program which, if a defective or missing book block clamp is detected, actuates the collating machine in such a way that no book block is collated for this defective or missing book block clamp. This has the advantage that a job can be finished despite defective clamps and the perfect binder and/or the book binding machine do/does not have to be stopped. As an alternative, it is possible to stop the book binding machine briefly, to remove the defective clamp and to further operate the book binding machine with the perfect binder without the defective clamp. The position of the defective and removed clamp within the book block transport system then remains empty. This makes it possible in an advantageous way for the defective clamp to be able to be repaired without time pressure outside the perfect binder.

In accordance with a further feature of the book binding machine of the invention, the perfect binder has at least one sensor for detecting the position of a respective book block clamp. As an alternative, the position of a respective book block clamp can also be stored in the control device.

In accordance with an added feature of the book binding machine of the invention, the book block clamps of the perfect binder are numbered. This makes it easier for the control device to assign one transport segment of the collating machine to a defined book block clamp in each case. There can also be provision for it to be possible for the machine operator to mark individual book block clamps as defective by number input through the use of an interface of the control device and, as a result, to supply information for an adapted operating method of the book binding machine to the control device. In one alternative structural variant, a respective book block clamp can also have an identification element which can be configured, for example, as an RFID tag or as a bar code. An identification element of this type, which is preferably attached to the rear side of the clamp, can then be read by a sensor which at the same time detects the position of a respective book block clamp.

In accordance with an additional feature of the book binding machine of the invention, the perfect binder of the book binding machine has a detection device for detecting defects of a book block clamp or for detecting the absence of a book block clamp. In this case, the detection device can be formed by one or more sensors, in particular optical sensors, or by a digital camera. A camera can serve to carry out an image comparison, in order to compare the actual state of a book block clamp with a setpoint or desired state which is stored in a data memory of the machine controller.

In accordance with again another feature of the book binding machine of the invention, the control device of the book binding machine has a machine program which, if a defective or missing book block clamp is detected, actuates the cover feeding station of the perfect binder in such a way that no cover is provided for the missing or defective book block clamp.

With the objects of the invention in view, there is concomitantly provided a method for operating a book binding machine as described above. In this case, the book block clamps of the perfect binder are monitored and, if a defective or missing book block clamp is detected, the collating machine is actuated in such a way that no book block is collated for that defective or missing book block clamp. In a first structural variant, the monitoring of the book block clamps can be carried out by the machine operator who inputs the information about defective or missing book block clamps into the control device of the book binding machine. In a second embodiment, the monitoring of the book block clamps can be carried out by a detection device, such as a camera or at least one sensor, with the information about defective or missing book block clamps being reported by the detection device to the control device.

Other features which are considered as characteristic for the invention are set forth in the appended claims.

Although the invention is illustrated and described herein as embodied in a book binding machine and a method for operating a book binding machine, it is nevertheless not intended to be limited to the details shown, since various modifications and structural changes may be made therein without departing from the spirit of the invention and within the scope and range of equivalents of the claims, noting that the described invention and the described advantageous developments of the invention also represent advantageous developments of the invention in any desired combination with one another.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a perspective view of a book binding machine according to the invention.

DETAILED DESCRIPTION OF THE INVENTION

Referring now in detail to the single FIGURE of the drawing, there is seen a book binding machine 100 with a collating machine 110, a transfer device 120, a perfect or adhesive binder 130 and a position 140 of a non-illustrated cooling section with a trimming station.

In the collating machine 110, individual signatures are deposited by feeders represented by arrows into transport segments T11, T12, T13, T14 of a gathering device 111 and thus collated to form book blocks B11, B12, B13. For the sake of improved clarity, the feeders are not shown. The book blocks B are moved in a transport direction $v_G$ by the collating machine 110 and are fed in the transport direction through the transfer device 120 to the perfect binder 130. The book blocks B are transported through the perfect binder 130 in a transport direction $v_B$ by a book block transport system 131, formed by driven clamps K which grip the book blocks B and circulate on a non-illustrated guide path. The book blocks B are transported to a first processing station, a spine processing station 132. The spine processing station 132 can have a plurality of non-illustrated processing tools. The book block B, which is processed on its spine, is transported further to a glue application station 133 and is provided there with adhesive by a spine gluing unit in the region of its spine and by a side gluing unit in the region near the spine on its side faces.

In a cover feeding and pressing station 134, covers U are fed in a feed direction $v_U$, are placed onto the book blocks B, are pressed on and thus both are connected to one another. Subsequently, the book blocks B with the adhesively bonded covers U, are transported further by a separate transport system through a cooling section and to the three-side trimming device at the position 140. The book block B is trimmed on three sides there and the finished book is produced.

The perfect binder 130 has a position sensor 135 which is configured as an optical sensor. The position sensor 135 serves to determine exactly the positions of the book block clamps K. In the illustration shown in the FIGURE, the position of the book block clamp K15 is last of all detected. An identification feature of the book block clamps K can also be read out by the sensor 135. In the snapshot shown in the FIGURE, no position detection can take place through the use of the sensor 135, since the book block clamp K14 is missing.

Furthermore, the perfect binder 130 has a detection camera 136 for checking the presence and the state of book block clamps K. In the snapshot shown in the FIGURE, the detection camera 136 determines that the book block clamp K14 is not present.

As is indicated by dashed, interrupted lines, the collating machine 110, the cover feeding station 134, the position sensor 135 and the detection camera 136 are connected to a common control device 150. The collating machine 110 (and therefore also its feeders) and the cover feeding station 134 can be actuated by the control device 150. Further elements and devices of the book binding machine 100 can also be connected to the control device 150.

If the detection camera 136 determines that a book block clamp Ki is defective or missing, this information is reported to the control unit 150. A machine program, which is stored in the control device 150, actuates the collating machine 110 in such a way that no book block Bi is collated for that book block clamp Ki, and actuates the cover feeding station 134 in such a way that no cover Ui is provided for the book block clamp Ki.

The snapshot illustrated in the FIGURE shows that no book block B14 is collated by the collating machine 110 for the missing book block clamp K14. The associated transport segment T14 of the gathering device 111 remains empty and unused. Likewise, no book block B16 has been provided by the collating machine 110 for the likewise missing book block clamp K16. A gap therefore moves through the perfect binder 130 in the position of the book block clamp K16. Likewise, no book block B5 has been provided for the likewise missing book block clamp K5. No cover U5 is provided as well by the cover feeder 134.

For the sake of clarity, only the operation in the case of missing book block clamps K is shown in the FIGURE. The method of operation of the book binding machine 100 is analogous, however, in the case of defective but present book block clamps K.

The invention claimed is:

1. A book binding machine, comprising:

a collating machine for collating book blocks, said collating machine having a gathering device with a plurality of transport segments and feeders configured to deposit individual sheets into each of said transport segments;

a perfect binder for processing the book blocks to produce perfect bound brochures or books, said perfect binder having a book block transport system with a plurality of book block clamps for transporting the book blocks through processing stations;

a transfer device disposed between said collating machine and said perfect binder for transferring the collated book blocks from said gathering device to said book block transport system; and a control device for actuating said collating machine and said perfect binder in common, said control device assigning each of said transport segments of said gathering device to a respective book block clamp, and said control device being programmed to actuate said collating machine if a defective or missing book block clamp is detected, so that no book block is collated for the defective or missing book block clamp.

2. The book binding machine according to claim 1, wherein the processing stations are selected from the group consisting of a spine processing station, an adhesive application station and a cover feeding station.

3. The book binding machine according to claim 1, wherein said perfect binder has at least one sensor for detecting a position of a respective book block clamp.

4. The book binding machine according to claim 1, wherein the book block clamps are numbered.

5. The book binding machine according to claim 1, wherein a respective book block clamp has an identification element.

6. The book binding machine according to claim 5, wherein said identification element is an RFID tag or a bar code.

7. The book binding machine according to claim 1, wherein said perfect binder has a detection device being signal-connected to said control device for detecting defects or an absence of a book block clamp.

8. The book binding machine according to claim 7, wherein said detection device is configured as an optical sensor or camera.

9. The book binding machine according to claim 1, wherein said perfect binder has a cover feeding station, and said control device is programmed to actuate said cover feeding station if a defective or missing book block clamp is detected, so that no cover is provided for the defective or missing book block clamp.

10. A method for operating a book binding machine, the method comprising the following steps:

providing the book binding machine with a collating machine for collating book blocks, said collating machine having a gathering device with a plurality of transport segments and feeders configured to deposit individual sheets into each of said transport segments, a perfect binder for processing the book blocks to produce perfect bound brochures or books, said perfect binder having a book block transport system with a plurality of book block clamps for transporting the book blocks through processing stations, a transfer device disposed between said collating machine and said perfect binder for transferring the collated book blocks from said gathering device to said book block transport system, and a control device;

actuating said collating machine and said perfect binder in common using the control device;

assigning each of said transport segments of said gathering device to a respective book block clamp using the control device;

monitoring the book block clamps; and upon detecting a defective or missing book block clamp, actuating said collating machine using the control device so that no book block is collated for the defective or missing book block clamp.

11. The method according to claim 10, which further comprises carrying out the monitoring step by a machine operator inputting information about the defective or missing book block clamp into said control device.

12. A method for operating a book binding machine, the method comprising the following steps:

providing the book binding machine with a collating machine for collating book blocks, said collating machine having a gathering device with a plurality of transport segments and feeders configured to deposit individual sheets into each of said transport segments, a perfect binder for processing the book blocks to produce perfect bound brochures or books, said perfect binder having a book block transport system with a plurality of book block clamps for transporting the book blocks through processing stations, a transfer device disposed between said collating machine and said perfect binder for transferring the collated book blocks from said gathering device to said book block transport system, and a control device;

actuating said collating machine and said perfect binder in common using the control device;

assigning each of said transport segments of said gathering device to a respective book block clamp using the control device;

providing said perfect binder with a detection device being signal-connected to said control device for detecting defects or an absence of a book block clamp;

monitoring the book block clamps with said detection device and reporting information about a defective or missing book block clamp to said control device; and upon detecting a defective or missing book block clamp, actuating the collating machine using the control device so that no book block is collated for the defective or missing book block clamp.

13. The method according to claim 12, wherein said detection device is configured as an optical sensor or camera.

* * * * *